US012686822B2

(12) United States Patent
Saffrin et al.

(10) Patent No.: US 12,686,822 B2
(45) Date of Patent: Jul. 21, 2026

(54) FLUE BLOCK WITH INTEGRATED RISERS FOR A HEATING WALL OF A COKE OVEN BATTERY

(71) Applicant: VANOCUR REFRACTORIES LLC, Tonawanda, NY (US)

(72) Inventors: Paul A. Saffrin, Tonawanda, NY (US); Richard M. Maida, Tonawanda, NY (US)

(73) Assignee: VANOCUR REFRACTORIES LLC, Tonawanda, NY (US)

( * ) Notice: Subject to any disclaimer, the term of this patent is extended or adjusted under 35 U.S.C. 154(b) by 190 days.

(21) Appl. No.: 18/701,487

(22) PCT Filed: Oct. 14, 2022

(86) PCT No.: PCT/US2022/078137

§ 371 (c)(1),
(2) Date: Apr. 15, 2024

(87) PCT Pub. No.: WO2023/064915

PCT Pub. Date: Apr. 20, 2023

(65) Prior Publication Data

US 2025/0230362 A1 Jul. 17, 2025

Related U.S. Application Data

(60) Provisional application No. 63/262,571, filed on Oct. 15, 2021.

(51) Int. Cl.
*C10B 29/02* (2006.01)
*C10B 5/02* (2006.01)
(Continued)

(52) U.S. Cl.
CPC ..... *C10B 29/02* (2013.01); *C10B 5/02* (2013.01); *C10B 5/12* (2013.01); *C10B 21/12* (2013.01)

(58) Field of Classification Search
CPC ..... C10B 29/02; C10B 29/06; C10B 5/02
See application file for complete search history.

(56) References Cited

U.S. PATENT DOCUMENTS 1,706,476 A 3/1929 Becker
1,754,131 A 4/1930 Ackeren
(Continued)

FOREIGN PATENT DOCUMENTS

DE 4103737 A1 8/1991
EP 0527318 A2 2/1993
(Continued)

OTHER PUBLICATIONS

European Patent Office, Extended European Search Report, Jan. 24, 2025, Munich, Germany.

*Primary Examiner* — Jonathan Luke Pilcher
(74) *Attorney, Agent, or Firm* — Simpson & Simpson, PLLC

(57) ABSTRACT

A flue block for a heating wall of a coke oven battery, the flue block having a proximal end and a distal end, the flue block comprising a first aperture disposed within the flue block, and a riser arranged in said first aperture. The flue block may also comprise a second aperture disposed therein, the second aperture spaced apart from the first aperture, and a second riser arranged in the second aperture. The flue block may be configured such that the riser is arranged to extend past the proximal end of the flue block. The flue block may be also configured such that the first riser extends past the proximal end. The flue block may be further configured such that the second riser extends past the proximal end.

17 Claims, 7 Drawing Sheets

(51) Int. Cl.
*C10B 5/12* (2006.01)
*C10B 21/12* (2006.01)

(56) References Cited

U.S. PATENT DOCUMENTS

| | | | | |
|---|---|---|---|---|
| 2,132,641 | A | 10/1938 | Otto | |
| 2,294,005 | A | 8/1942 | Alan et al. | |
| 2,863,807 | A | 12/1958 | Ackeren | |
| 3,190,815 | A | 6/1965 | Chang | |
| 3,261,763 | A | 7/1966 | Tucker, Jr. | |
| 3,345,051 | A | 10/1967 | Van Ackeren | |
| 3,488,259 | A | 1/1970 | Grumm | |
| 3,839,158 | A | 10/1974 | Helm | |
| 5,423,152 | A | 6/1995 | Kolvek | |
| 6,066,236 | A | 5/2000 | Gilroy | |
| 7,827,689 | B2 * | 11/2010 | Crane | C10B 29/06 29/402.09 |
| 10,927,302 | B2 * | 2/2021 | Bowser, Jr. | F27D 1/0006 |
| 2008/0169578 | A1 | 7/2008 | Crane et al. | |
| 2018/0362854 | A1 | 12/2018 | Bowser, Jr. et al. | |

FOREIGN PATENT DOCUMENTS

| | | | |
|---|---|---|---|
| GB | 155316 | A | 12/1920 |
| GB | 432345 | A | 7/1935 |
| JP | 2016222758 | A | 12/2016 |
| JP | 2017137447 | A | 8/2017 |

* cited by examiner

FLUE BLOCK WITH INTEGRATED RISERS FOR A HEATING WALL OF A COKE OVEN BATTERY

CROSS-REFERENCE TO RELATED APPLICATIONS

This application claims the benefit under Articles 4 and 8 of the Stockholm Act of the Paris Convention for the Protection of Industrial Property of U.S. Provisional Patent Application No. 63/216,571, filed on Oct. 15, 2021, which application is hereby incorporated by reference herein in its entirety.

FIELD

The present invention relates to coke ovens, and more particularly, to a flue block including integrated risers to facilitate proper dispersion of fluids, gases, and/or heat, in a flue.

BACKGROUND

Coke is typically produced by heating coal in a coke oven battery. This battery may have anywhere from 40 to over 100 side-by-side coking chambers or ovens separated from each other by heating walls. Gas is burned within the walls to heat the coal arranged in the ovens. The floor bricks of each oven rest upon corbels. Below the corbels is an area called the regenerator. The regenerator is filled with bricks that have a relatively large amount of surface area per volume, generally due to slots formed in the bricks. In the regenerator, exhaust waste heat is used to pre-heat incoming air as well as cool the exhaust waste heat prior to discharge. The slotted bricks are called checker bricks, and they facilitate the heat transfer from the exhaust waste heat to the combustion materials. The regenerator supports the corbels. In turn, the corbels support the coke oven floor bricks and the heating walls. The heating walls, floor bricks, and corbels have traditionally been made of silica brick.

Coal is crushed and blended prior to being charged in a coke oven. A larry car charges the individual oven with the blended coal. In the coke oven, the coal is heated to 1,800° F. for up to 18 hours—thus the importance of the regenerator to conserve heat. During that time, the volatiles of the coal are driven into the offgas (removed), and a pure carbon form called "coke" remains.

However, current coke oven battery designs do not allow for optimal air and gas flow within the heating wall, specifically the flue, and lead to undesirable heating characteristics (i.e., loss of heat, increased fluid pressure within the flue, etc.) For example, current coke oven battery designs do not mix gas and air at various elevational levels throughout the oven wall. Furthermore, current coke oven battery designs do not ensure proper fluid flow rates in the flue.

Thus, there is a long felt need for a flue block that includes integrated risers therein to mix air and gas at various elevational levels within a flue and improves air and gas flow therein.

There is another long felt need for a flue block that includes integrated risers therein, where the flue block may have two risers having different heights.

SUMMARY

The present invention generally comprises a flue block for a heating wall of a coke oven battery, the flue block having a proximal end and a distal end, the flue block comprising a first aperture disposed within the flue block, and a riser arranged in said first aperture. The flue block may also comprise a second aperture disposed therein, the second aperture spaced apart from the first aperture, and a second riser arranged in the second aperture. The flue block may be configured such that the riser is arranged to extend past the proximal end of the flue block. The flue block may be also configured such that the first riser extends past the proximal end. The flue block may be further configured such that the second riser extends past the proximal end.

In other embodiments the first side surface comprises a recess. In some embodiments, the second side surface comprises a protrusion. In some embodiments, the top surface comprises at least one groove. In some embodiments, the first hole is bounded by at least one wall, and the first riser extends from the at least one wall. In some embodiments, the first riser comprises a recess extending from the top surface. In some embodiments, the first riser comprises a countersink extending from the bottom surface. In some embodiments, the flue block further comprises a second hole extending from the top surface to the bottom surface, the second hole being spaced apart from the first hole, and a second riser arranged in the second hole. In some embodiments, the second hole is defined by at least one wall, and the second riser extends from the at least one wall. In some embodiments, the second riser comprises a recess extending from the top surface. In some embodiments, the recess is constant in width in a first direction, and variable in width in a second direction, perpendicular to the first direction. In some embodiments, the second riser comprises a countersink extending from the bottom surface.

The present invention also generally comprises a coke oven battery. The coke oven battery comprises a heating wall, including a first flue, and a second flue spaced apart from the first flue, and a flue block for a heating wall of a coke oven battery, comprising a top surface, a bottom surface, a front surface, a rear surface, a first side surface, a second side surface, a first hole extending from the top surface to the bottom surface, the first hole in fluid communication with the first flue, and a first riser arranged in the first hole.

The coke oven battery may further comprise a second hole (or aperture) extending from the top surface to the bottom surface, the second hole in fluid communication with the second flue, and a second riser arranged in the second hole. In some embodiments, the first hole is defined by at least one wall, and the first riser extends from the at least one wall. In some embodiments, at least one of the first riser and the second riser comprises a countersink extending from the bottom surface. In some embodiments, the first riser comprises a counterbore recess extending from the top surface. In some embodiments, the second riser comprises a recess extending from the top surface. In some embodiments, the recess comprises a variable width. In some embodiments, the second hole (or aperture) is defined by at least one wall, and the second riser extends from the at least one wall.

The present invention may further comprise a coke oven battery, the battery comprising a heating wall, the first heating wall includes a first flue, and a second flue spaced apart from the first flue, and a flue block for a heating wall of a coke oven battery, the flue block includes a top surface, a bottom surface, a front surface, a rear surface, a first side surface, a second side surface, a first aperture extending from the top surface to the bottom surface, the first aperture in fluid communication with the first flue, and a first riser arranged in the first aperture. The coke oven battery may further comprise a second aperture extending from the top surface to the bottom surface, the second aperture in fluid communication with the second flue, and a second riser arranged in said second aperture. The coke oven battery may also be configured such that the first aperture is defined by at least one wall, the first riser extends from the at least one wall, the second aperture is defined by at least one wall, the second riser extends from the at least one wall, wherein at least one of the first riser and the second riser comprises a countersink extending from the bottom surface, wherein the first riser comprises a counterbore recess extending from the top surface, wherein the second riser comprises a recess extending from the top surface.

Generally, the primary object of the present invention, in its various embodiments, is to provide for mixing of air and gas within a flue of a heating wall of a coke oven battery, specifically, in some embodiments of the present invention, the flue block is configured such that the mixing of air and gas may occur at different elevations within the flue block, thereby providing for better combustion characteristics and potentially decreasing inefficiencies in existing coke oven batteries, where the flue block of the present invention may be used during repair of the existing coke oven batteries.

In some embodiments, the present invention may generally comprise a heating wall of a coke oven battery, the heating wall comprising a plurality of flue blocks, each of the flue blocks including a flue, at least two risers, where each riser is located within one of the plurality of flues, wherein the at least two risers are of different heights.

In other configurations, the present invention may generally comprise a heating wall of a coke over battery, comprising a plurality of flue blocks, each of the flue blocks including a flue and at least one riser positioned within one of the flues.

These and other objects, features, and advantages of the present invention will become readily apparent upon a review of the following detailed description, in view of the drawings and appended claims.

BRIEF DESCRIPTION OF THE DRAWINGS

Various embodiments are disclosed, by way of example only, with reference to the accompanying schematic drawings, in which corresponding reference symbols indicate corresponding parts, in which.

DETAILED DESCRIPTION

Figure 1:
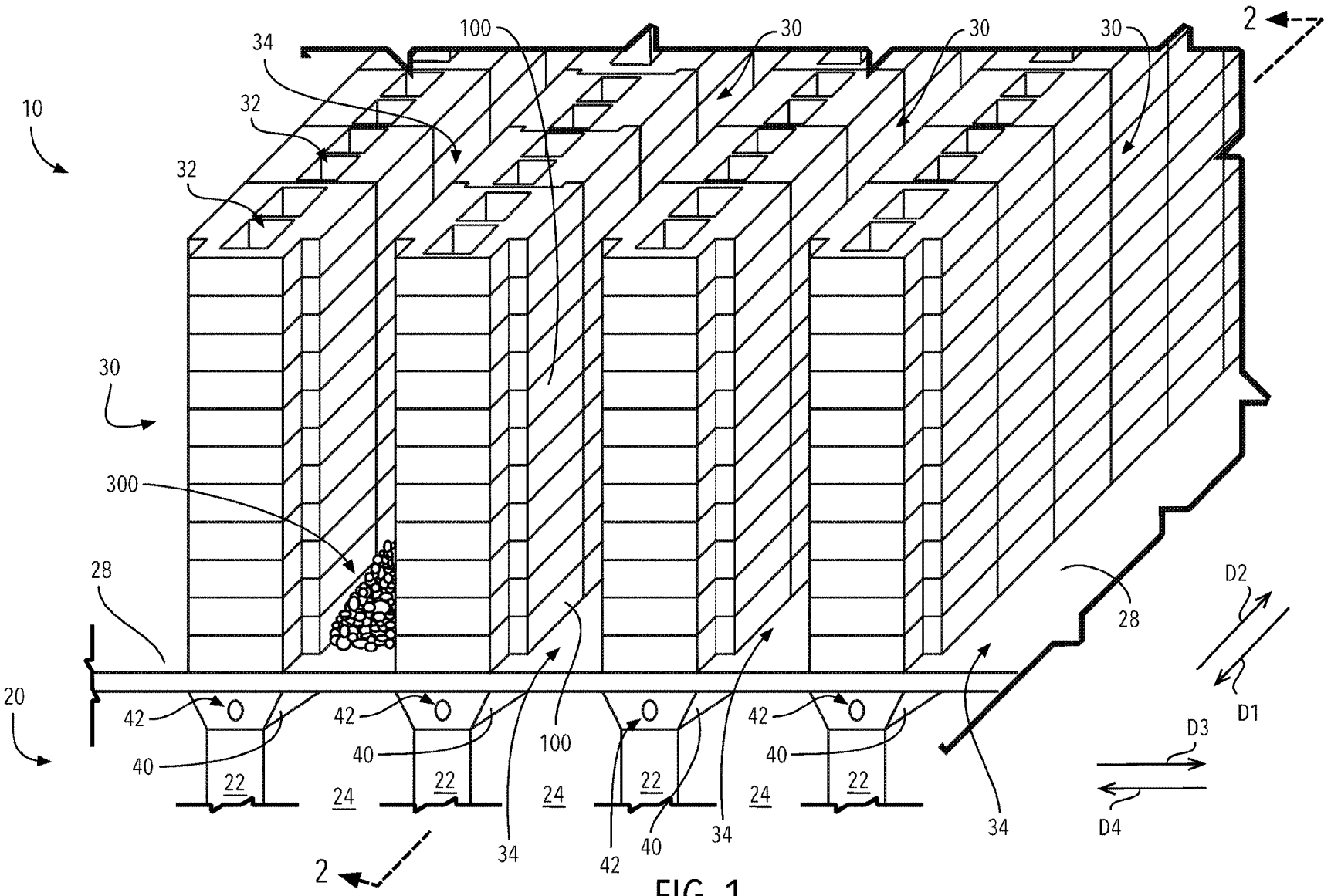
FIG. 1 is a partial perspective view of a coke oven battery, in accordance with some embodiments of the present invention.

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments. The assembly of the present disclosure could be driven by hydraulics, electronics, pneumatics, and/or springs.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

It should be understood that use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein.

As also used herein, the terms "fluid communication", "communication", and/or substantial equivalents thereof, are meant to mean two or more components are connected such that a substance, e.g., gases, fluid, etc., can flow between and/or within the two components. "Fluid communication", "communication", and/or equivalents thereof, are also intended to include heat transfer between two or more components.

It should be appreciated that the terms "surface" and "end", used herein, are substantially interchangeable.

Coke Oven Battery

Figure 2:
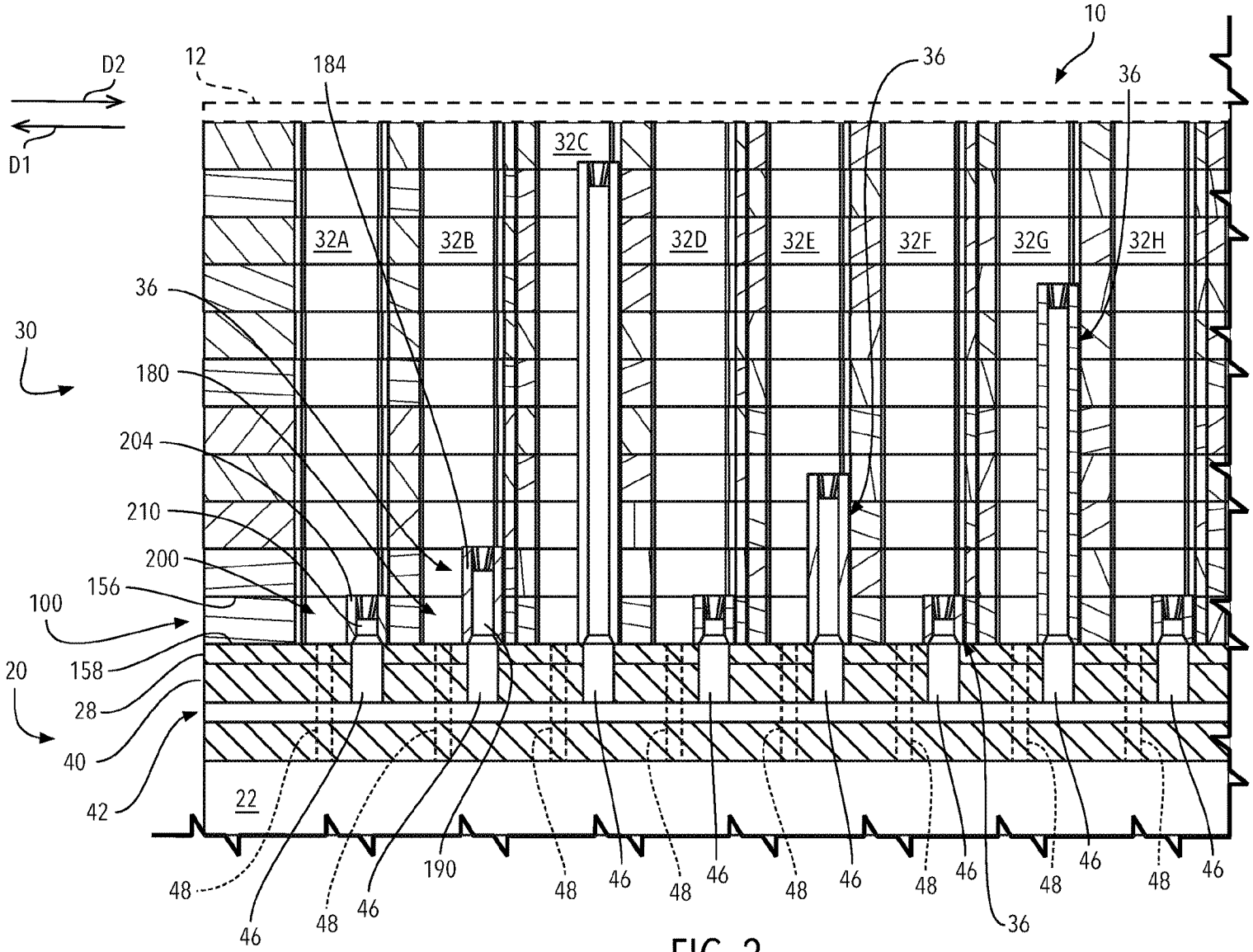
FIG. 2 is a partial cross-sectional view of the coke oven battery taken generally along line 2-2 in FIG. 1.

Referring now to the figures, FIG. 1 is a partial perspective view of coke oven battery 10, in accordance with some embodiments of the present disclosure. FIG. 2 is a partial cross-sectional view of coke oven battery 10 taken generally along line 2-2 in FIG. 1. Coke oven battery 10 generally comprises regenerator 20 and one or more ovens 34.

Regenerator 20 comprises a plurality of piers or pillars 22, which are spaced apart to form regenerator regions 24. In some embodiments, each of pillars 22 comprises a plurality of bricks or blocks. Pillars 20 support corbels 40. Each of corbels 40 comprises a plurality of blocks. In some configurations, corbels 40 comprise a plurality of blocks arranged in a plurality of tiers.

Corbels 40 are arranged on top of pillars 20 and support the oven section of coke oven battery 10. Specifically, corbels 40 support floor 28, heating walls 30, and coal 300 placed in ovens 34, allow air to flow between flues 32 and regenerator 20, and/or allow gas to be injected into flues 32. For example, gas or fuel is injected into corbels 40 horizontally via hole or through-bore 42 and flows vertically through through-bores 46 and into flues 32. Air flows up through through-bores 48 and into flues 32 where it mixes with the fuel and combusts to heat heating walls 30, thus cooking the coal arranged in ovens 34, transforming it into coke. (Coal 300 shown in the drawing is merely representative. In practice, the coal is crushed and blended prior to being charged in the coke oven). Exhaust gases are created from such combustion, these hot exhaust gases may flow down through through-bores 48 and into regenerator regions 24, thereby preheating the incoming gas and/or air. Preheating gas and/or air as it flows into flues 32 prior to combustion is desirable because it produces more efficient vaporization and higher combustion efficiency than cold fuel. Coke oven battery 10 may further comprises shut-off means (not illustrated) operatively arranged to selectively shut off the gas flow through one or more through-bores 42. The shut-off means (e.g., valves) allow the operator to control the temperature in each flue 32 and thus ovens 34. As shown in FIGS. 1 and 2, coke oven battery 10 further comprises one or more flue blocks or modules 100 operatively arranged to facilitate the optimal transfer of fluids between corbels 40 and regenerator 20, and flues 32, as will be described in greater detail below.

Floor 28 is arranged on and/or engaged with corbels 40. Floor 28 is operatively arranged to support the coal in ovens 34. Floor 28 may comprise a plurality of blocks, where the plurality of blocks may be arranged in a plurality of tiers. Heating walls 30 are arranged on corbels 40 and/or floor 28 and comprise flues 32 arranged therein (32A-32H in FIG. 2), respectively. Flues 32 (flues 32A-32H in FIG. 2) are in fluid communication with through-bores 46 and through-bores 48. An oven ceiling can be arranged proximate the, or on, top of heating walls 30. Thus, coking ovens 34 are formed by floor 28, heating walls 30, and the oven ceiling. A battery top (represented in broken lines and "12" in FIG. 2) can be arranged on top of heating walls 30 and may enclose flues 32. In some configurations of coke oven 10, each flue 32 is in fluid communication with at least one through-bore 46 and at least one through-bore 48, which thereby provides gas (via through-bore 46) and air (via through-bore 48) to that flue. The arrangement of having at least one gas injection through-bore 46 and an air injection through-bore 48 in a single flue provides a desirable combustion mixture of air and fuel. Further, flue block 100 comprises risers, or vertical pipes, fluidly connected to through-bores 46 and through-bores 48 such that air and gas is mixed at different elevational levels within flues 32, as will be described in greater detail below.

Flue Block

Figure 3A:
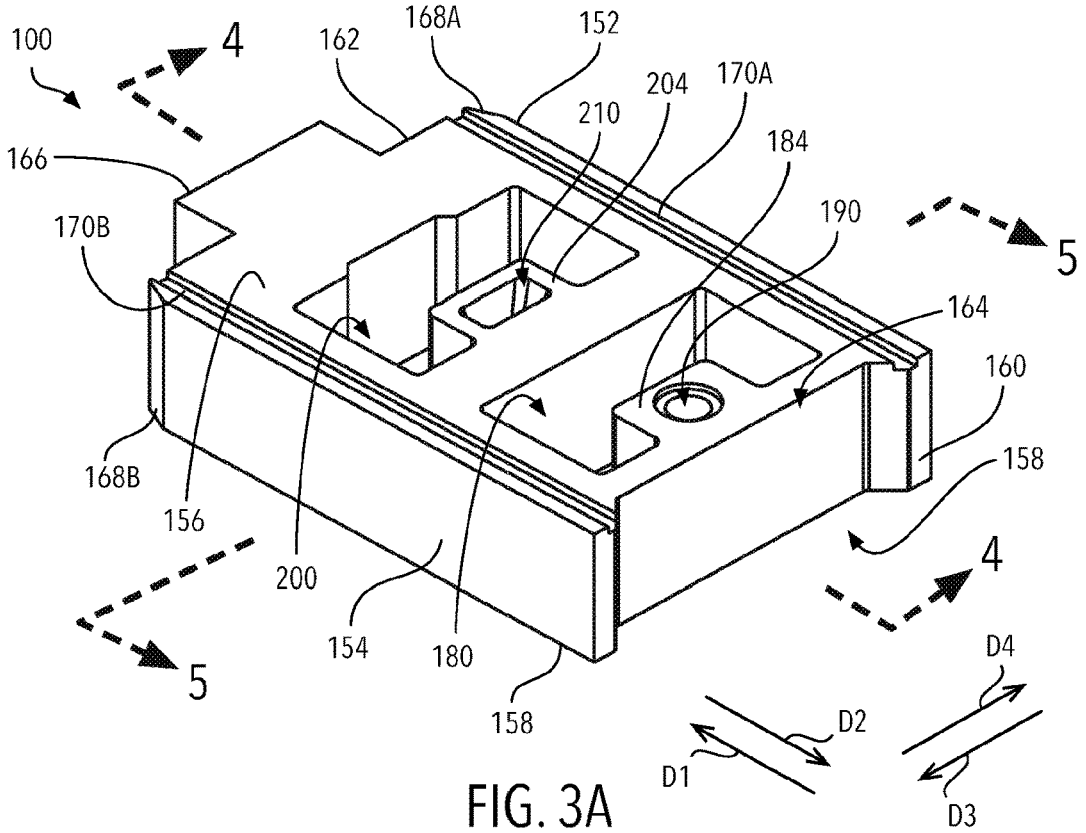
FIG. 3A is a top front perspective view of a flue block, as shown in FIG. 1.
Figure 3B:
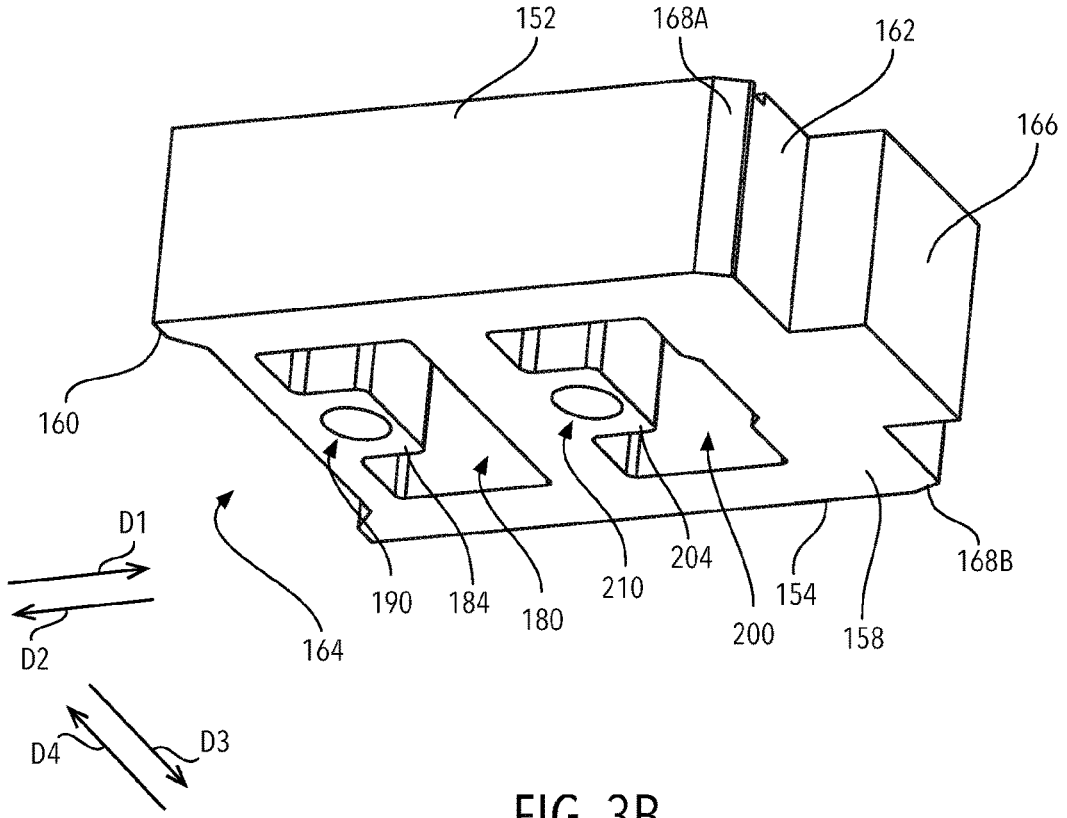
FIG. 3B is a bottom rear perspective view of the flue block shown in FIG. 3A.
Figure 3C:
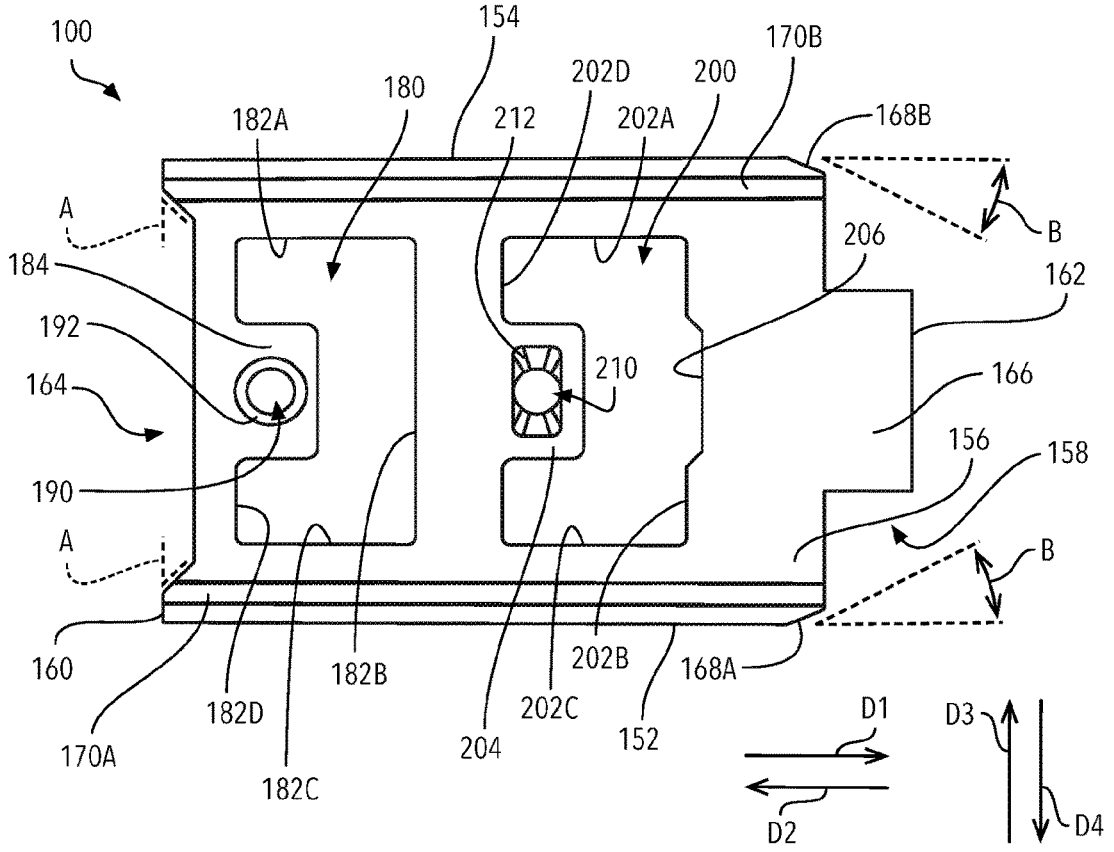
FIG. 3C is a top elevational view of the flue block shown in FIG. 3A.
Figure 4:
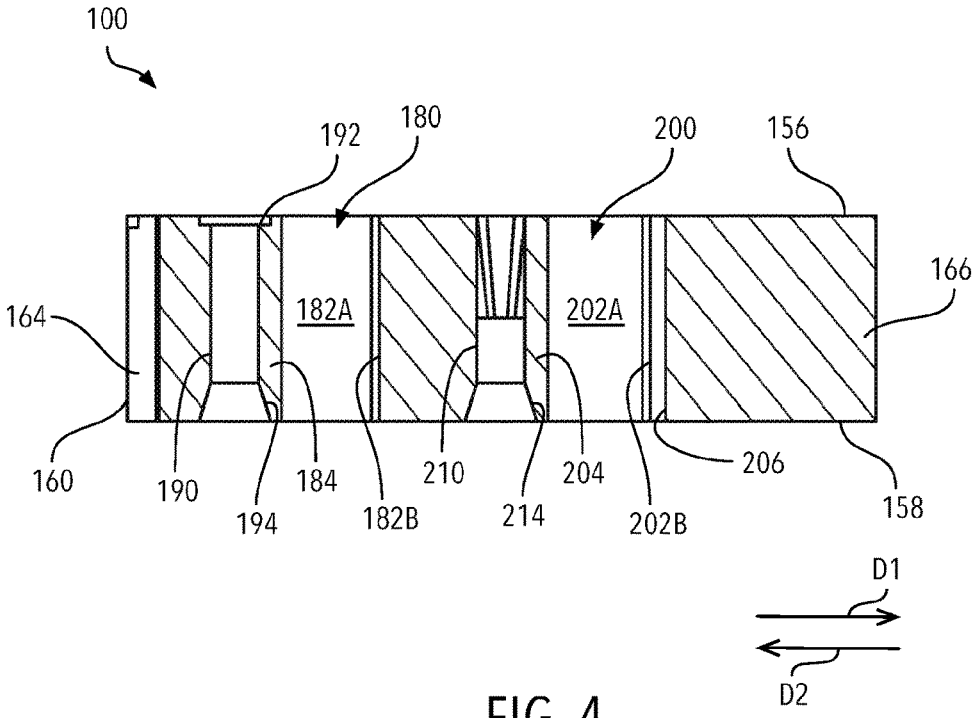
FIG. 4 is a cross-sectional view of the flue block taken generally along line 4-4 in FIG. 3A.
Figure 5:
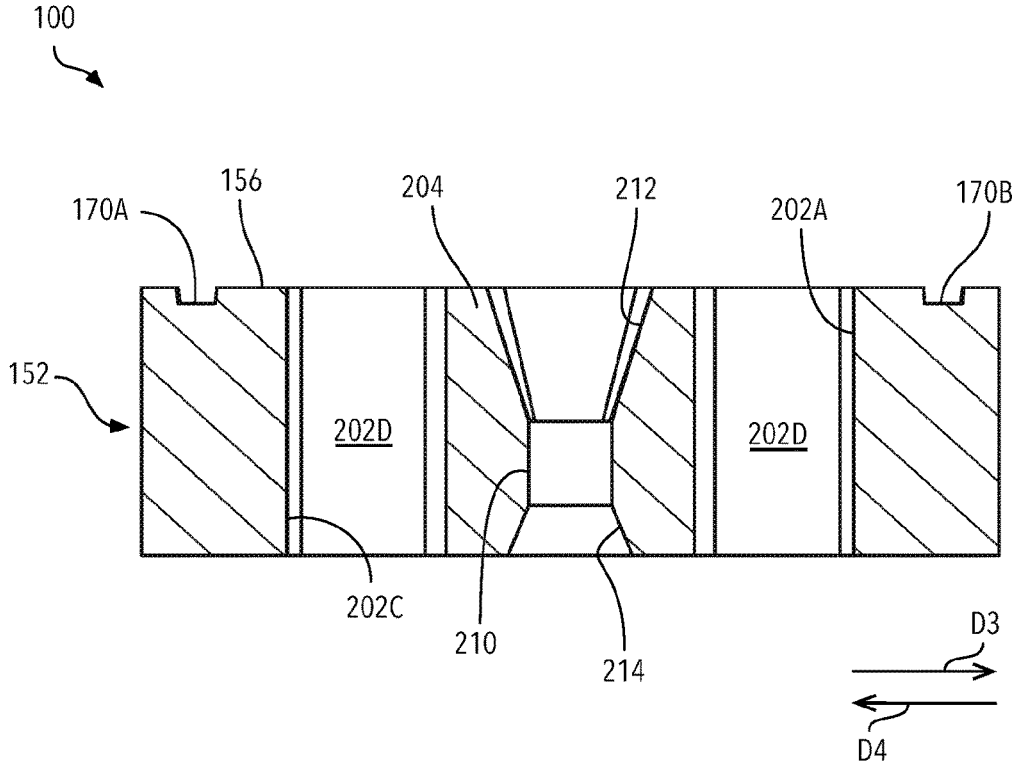
FIG. 5 is a cross-sectional view of the flue block taken generally along line 5-5 in FIG. 3A.

FIG. 3A is a top front perspective view of flue block 100. FIG. 3B is a bottom rear perspective view of flue block 100. FIG. 3C is a top elevational view of flue block 100. FIG. 4 is a cross-sectional view of flue block 100 taken generally along line 4-4 in FIG. 3A. FIG. 5 is a cross-sectional view of flue block 100 taken generally along line 5-5 in FIG. 3A.

Flue block 100 comprises front surface 152, rear surface 154, top surface 156 (or proximal surface), bottom surface 158 (or distal surface), side surface 160, and side surface 162. In some embodiments, front surface 152 is arranged parallel to rear surface 154. In other embodiments, top surface 156 is arranged parallel to bottom surface 158. Side surface 160 may be arranged parallel to side surface 162. In a preferred embodiment flue block 100 is a single integrally formed element, as flue block 100 must also be composed of a material composition that can withstand at least 1,800° F. without deformation or deterioration—although flue block 100 may be configured with separate components that are fixedly secured thereto. It should be further appreciated that flue block 100 is composed of a material composition that can withstand the aforementioned temperature minimum during daily operation of the coke oven battery for a minimum of 20 years. The aforementioned material composition of flue block 100 preferably is approximately 90%, or greater, of SiO2 (Silicon Dioxide) and has modulus of rupture is approximately 6.9 MPa (MegaPascal) at 1090° C. and 3.5 MPa at 1480° C.

Side surface 160 preferably comprises recess 164. Recess 164 extends into side surface 160 in direction D1 and comprises a bottom surface and two side surfaces. The bottom surface is arranged parallel to side surface 160. The two side surfaces are arranged at angle A with respect to side surface 160. In some embodiments, angle A is an acute angle. In some configurations of flue block 100, recess 164 extends from top surface 156 to bottom surface 158. Recess 166 is substantially a "recessed section" or "recessed portion" and may be configured with different lengths, widths, shapes to accommodate different coke oven configurations-during repair and/or construction.

Side surface 162 comprises protrusion 166. Protrusion 166 extends from side surface 162 in direction D1. Protrusion 166 comprises a top surface and two side surfaces. As illustrated, the top surface, or proximal surface, is arranged parallel to side surface 162 and the two side surfaces are arranged perpendicular to side surface 162. In some embodiments, protrusion 166 extends from top surface 156 to bottom surface 158. Protrusion 166 is substantially a "protruding section" or "protruding portion" and may be configured with different lengths, widths, shapes to accommodate different coke oven configurations-during repair and/or construction.

It should be noted that recess 164 of flue block 100 is arranged to at least partially accept protrusion 166 of an adjacently arranged flue block 100 therein—eliminating and/or limiting movement in directions D3 and D4 (as referenced in FIG. 3A) between the two adjacently arranged flue blocks.

Flue block 100 may further comprise at least one tapered surface, such as tapered surfaces 168A-B. Tapered surface 168A extends from front surface 152 to side surface 162 and tapered surface 168B extends from rear surface 154 to side surface 162. Tapered surfaces 168A-B effectively reduce a width of flue block 100. Tapered surfaces 168A-B are arranged at angle B with respect to front surface 152 and rear surface 154, respectively. In some embodiments, angle B is an acute angle. In a preferred embodiment, top surface 156 comprises at least one groove, for example grooves 170A-B. Groove 170A is arranged proximate to front surface 152 and extends from side surface 160 to side surface 162. In alternative configurations, groove 170A does not extend from side surface 160 to side surface 162. Groove 170B is arranged proximate to rear surface 154 and extends from side surface 160 to side surface 162. In other embodiments, groove 170B does not extend from side surface 160 to side surface 162. Although not illustrated, flue block 100 may also include at least one protruding member, extending from bottom surface 158, substantially collinearly arranged with a respective groove, 170A and/or 170B, and extending from side surface 160 to side surface 162. This protruding member is arranged to be seated in one of the grooves, 170A and/or 170B when the respective flue block is arranged on top of another flue block, thereby limiting movement in directions D3 and D4.

Flue block 100 further comprises aperture or flue 180 extending from top surface 156 to bottom surface 158. Aperture 180 forms at least a portion of the flue with which it is aligned. Aperture 180 may be defined by walls 182A-D. Alternatively, aperture 180 may be defined by a singular wall, i.e., circular, or rounded. Wall 182A is parallel to wall 182C, and wall 182B is parallel to wall 182D. Riser 184 is arranged in aperture 180. Specifically, riser 184 extends from wall 182D in direction D1. As shown and in a preferred embodiment, riser 184 is arranged between and spaced apart from walls 182A and 182C—although it should be appreciated that riser 184 may be positioned alternatively within aperture 180. Riser 184 comprises through-bore 190 which extends completely therethrough. Hole 190 is operatively arranged to be in fluid communication with through-bore 46. Specifically, gas flows through through-bore 42, up through through-bore 46, and then up through through-bore 190. Riser 184, and thus through-bore 190, is considered a "pass through" riser in that gas does not release into flue 32 therefrom. Rather, after flowing through through-bore 190, gas enters an additional conduit 36, as best shown in FIG. 2, such that it can be released into flue 32 at a higher elevational level. In some embodiments, gas is released into flue 32 from through-bore 190. In some embodiments, through-bore 190 comprises counterbore or recess 192 extending from top surface 156 (See FIG. 4). Recess 192 may interact with a nipple or protrusion on conduit 36 such that a better seal is formed therebetween-a fluid connection is formed. In some embodiments, through-bore 190 comprises countersink or recess 194 extending from bottom surface 158. Countersink 194 forms a nozzle of decreasing diameter that increases the velocity of the gas flowing from corbel 40 to flues 32.

The portion of aperture 180 formed around riser 184 is in fluid communication with or fluidly connected to through-bore 48. Thus, the flow of air and exhaust gases between flues 32 and regenerator 20 occurs through aperture 180. Air, exiting through-bore 46, is mixed with gas in flue 32B elevationally above top surface 156, after such air flows through aperture 180 around riser 184, and up past conduit 36 (See, FIG. 2).

Flue block 100 further comprises aperture or flue 200 extending from top surface 156 to bottom surface 158. Aperture 200 forms at least a portion of the flue with which it is aligned. Aperture 200 is defined by walls 202A-D. Alternatively, aperture 200 may be defined by a single wall, i.e., circular or rounded. Wall 202A may be arranged parallel to wall 202C, and wall 202B may be arranged parallel to wall 202D. Riser 204 is arranged in aperture 200. Specifically, riser 204 extends from wall 202D in direction D1. In some embodiments, riser 204 is arranged between and spaced apart from walls 202A and 202C. Riser 204 comprises through-bore 210 which extends completely therethrough. Through-bore 210 is operatively arranged to be in fluid communication with through-bore 46. Specifically, gas flows through through-bore 42, up through through-bore 46, and then up through through-bore 210. Riser 204, and thus through-bore 210, is considered a "distribution" riser in that gas is released into flue 32 directly therefrom. For example, as best shown in FIG. 2, gas is released into flue 32A directly from riser 204. In some embodiments, through-bore 210 is connected to a conduit such that gas is released at a higher elevational level within the flue. Through-bore 210 may also comprise recess 212, disposed within top surface 156. Recess 212 preferably has a constant width, or a width equal to that of through-bore 210, in direction D1 and direction D2 (See FIG. 4). Recess 212 comprises a variable width in direction D3 and direction D4, specifically, increasing in width from through-bore 210 to top surface 156 (See FIG. 5). The increase in the width of through-bore 210 approaching the output of riser 204 acts as an eductor, or divergent nozzle, which increases the volume of the gas being released into the flue. This configuration provides for a better mixing of gas and air and thus better combustion within the flue. In some embodiments, through-bore 210 comprises countersink or recess 204 extending from bottom surface 158. Countersink 204 forms a nozzle of decreasing diameter that increases the velocity of the gas flowing from corbel 40 to flues 32.

Wall 202B may further comprises recess 206. Recess 206 extends from top surface 156 to bottom surface 158. As shown, recess 206 is arranged between and spaced apart from wall 202A and wall 202C. Recess 206 comprises a bottom surface and two side surfaces. In some configurations, the bottom surface is arranged parallel to wall 202B and the two side surfaces are tapered in direction D1.

The portion of aperture 200 formed around riser 204 is in fluid communication with or fluidly connected to through-bore 48. Thus, the flow of air and exhaust gases between flues 32 and regenerator 20 occurs through aperture 200. In some embodiments, and as shown, air from through-bore 46 is mixed with gas in flue 32A at top surface 156, after such air flows through aperture 200 around riser 204 (See FIG. 2).

In an example embodiment, and as best shown in FIG. 2, flue block 100 is arranged on corbel 40 such that bottom surface 158 is engaged therewith. Aperture 180 and riser 184 is arranged in/fluidly connected to flue 32B. Specifically, air from regenerator 20 flows into flue 32B via aperture 180 and through-bore 48. Through-bore 190 is fluidly connected to through-bore 46 such that gas flows into flue 32B through through-bore 190. In some embodiments, through-bore 190 is further connected to conduit 36 such that gas is released into flue 32B at an elevationally higher level than top surface 156. Aperture 200 and riser 204 is arranged in/fluidly connected to flue 32A. Specifically, air from regenerator 20 flows into flue 32A via aperture 200 and through-bore 48. Through-bore 210 is fluidly connected to through-bore 46 such that gas flows into flue 32A through through-bore 210 at top surface 156.

Flue Block: Alternative Configurations

Figure 6A:
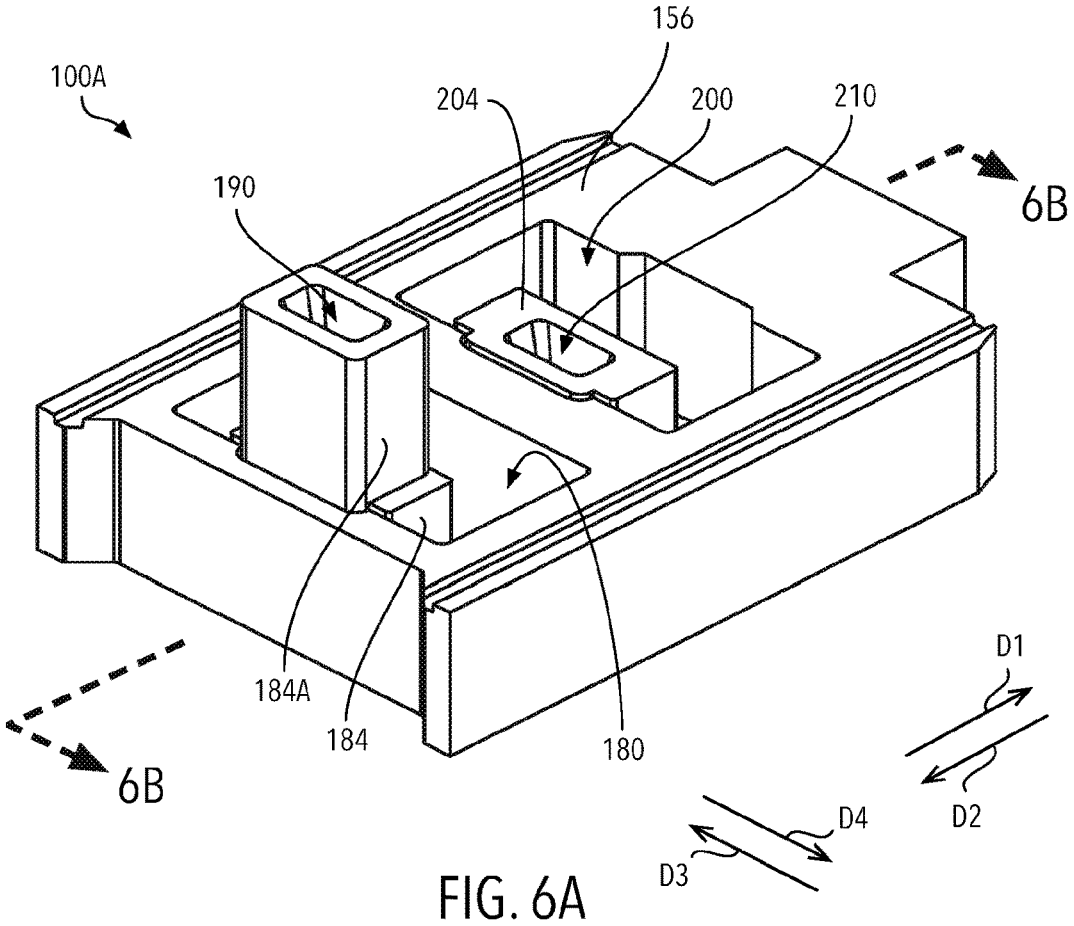
FIG. 6A is a perspective view of an alternative configuration of the flue block shown in FIG. 3A.
Figure 6B:
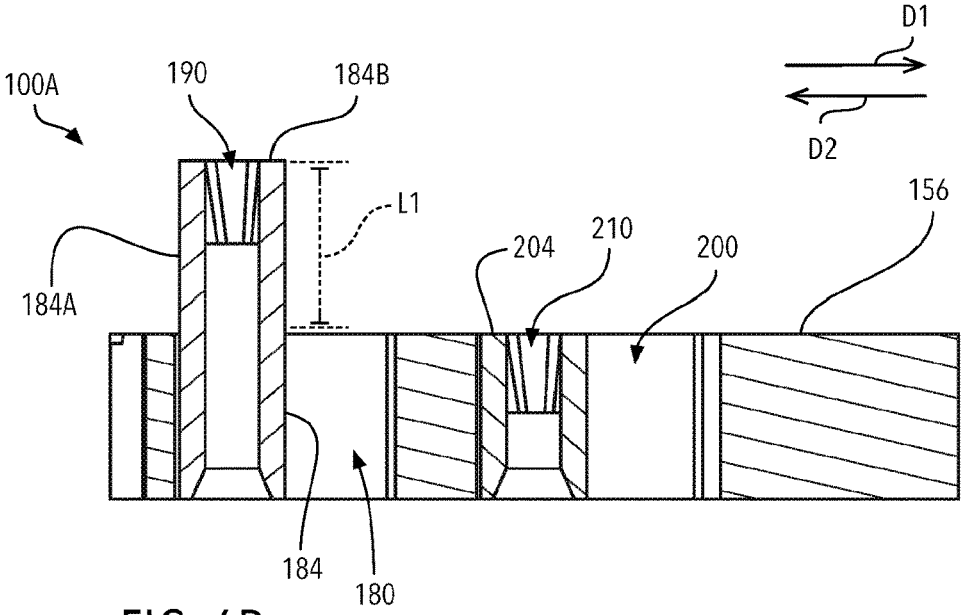
FIG. 6B is a cross-sectional view taken generally along line 6B-6B in FIG. 6A.
Figure 7A:
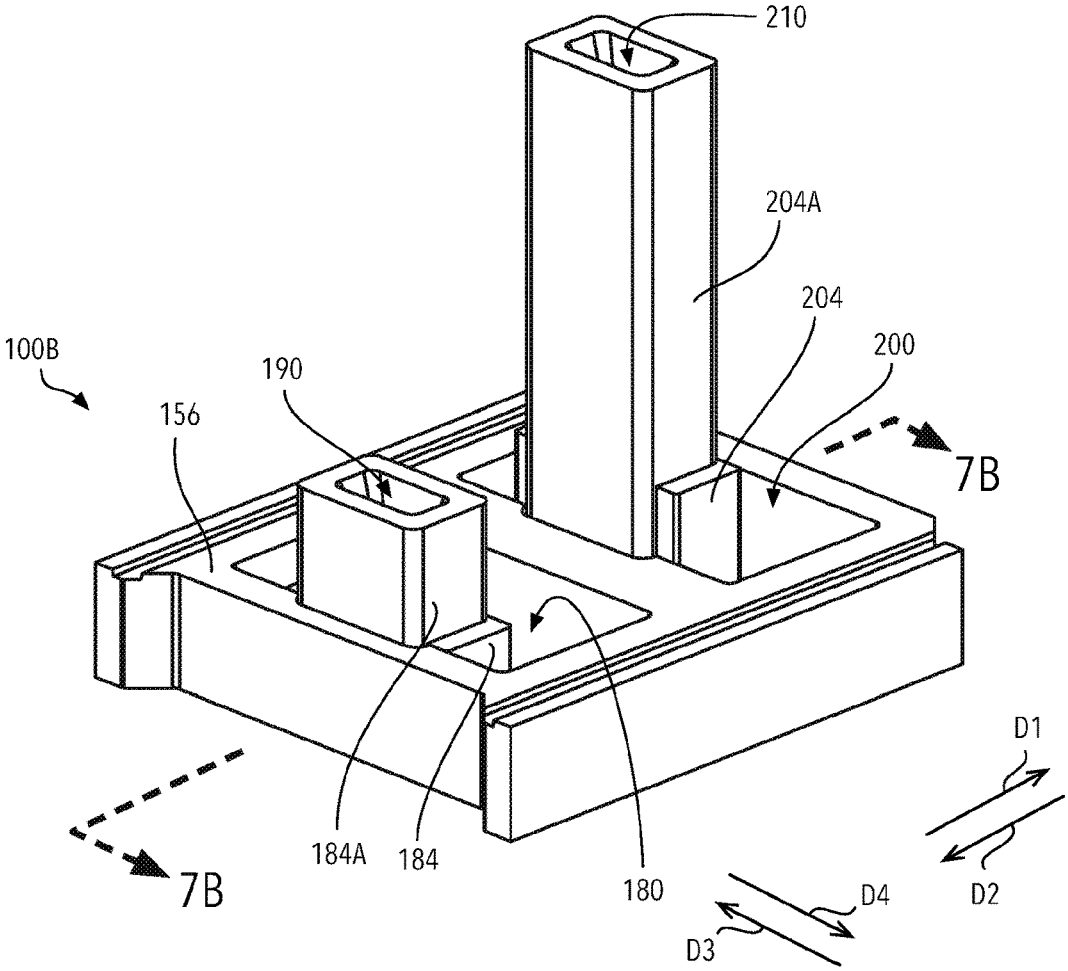
FIG. 7A is a perspective view of a second alternative configuration of the flue block shown in FIG. 3A; and, FIG. 7B is a cross-sectional view taken generally along line 7B-7B in FIG. 7A.
Figure 7B:
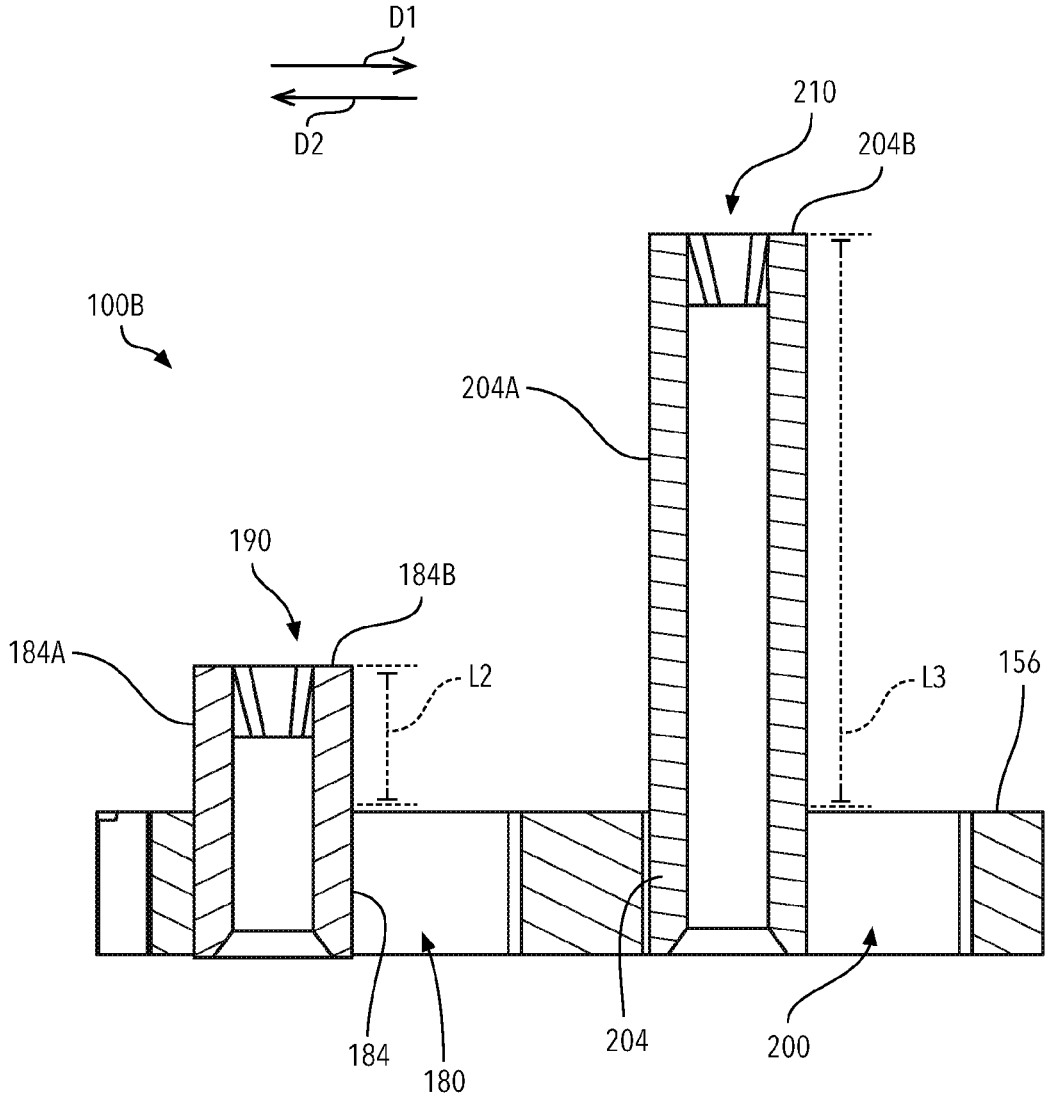

The following description should be taken in consideration of the aforementioned figures and FIGS. 6A through 7B. FIGS. 6A through 7B generally illustrate alternative configurations of flue block 100, specifically FIG. 6A illustrates a perspective view of flue block 100A, FIG. 6B illustrates a cross-sectional view taken generally along lines 6B-6B in FIG. 6A, FIG. 7A illustrates a perspective view of flue block 100B, and FIG. 7B illustrates a cross-sectional view taken generally along lines 7B-7B in FIG. 7A. Broadly, flue blocks 100A and 100B are representative embodiments of alternative configurations of flue block 100, and comprise substantially the same components, as described supra.

Flue block 100A includes extension 184A. Extension 184A is arranged to extend from riser 184 and in a direction away from top surface 156. Extension 184A is substantially equivalent to conduit 36, shown in FIG. 2. Extension 184A (or conduit) allows gas traveling through through-bore 190 to be released into a flue at an elevationally higher level than top surface 156. This distance between apex 184B of extension 184A and top surface 156 is length L1.

Flue block 110B includes extensions 184A and 204A, extending from risers 184 and 204, respectively. Extensions 184A and 204A are arranged to extend from their respective risers in a direction away from top surface 156. Extension 184A (or conduit) allows gas traveling through through-bore 190 to be released into a flue at an elevationally higher level than top surface 156. This distance between apex 184B of extension 184A and top surface 156 is length L2. Extension 204A (or conduit) allows gas traveling through through-bore 210 to be released into a flue at an elevationally higher level than top surface 156, and at an elevationally higher level than extension 184A—allowing greater variation in the elevational levels of mixing between gas and air. The distance between apex 184B of extension 184A and top surface 156 is length L2. The distance between apex 204B of extension 204A and top surface 156 is length L3—greater than L2.

It should be noted that various components of the flue block of the present invention may have variations. For example, the through-bores described supra, are not limited to a cylindrical shape, and may take alternative forms, e.g., rectangular, triangular, etc. As such, the risers, apertures, countersinks, recesses, and the like, may also take alternative forms.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

10 Coke oven battery
12 Battery top
20 Regenerator
22 Pier or pillar
24 Regenerator region
28 Floor
30 Heating wall(s)
32 Flue(s)
32A Flue
32B Flue
32C Flue
32D Flue
32E Flue
32F Flue
32G Flue
32H Flue
34 Oven
36 Conduit
40 Corbel
42 Through-bore
46 Through-bore
48 Through-bore
100 Flue block or module
100A Flue block or module
100B Flue block or module
152 Front surface
154 Rear surface
156 Top surface
158 Bottom surface
160 Side surface
162 Side surface
164 Recess
166 Protrusion
168A Taper
168B Taper
170A Groove
170B Groove
180 Aperture or flue
182A Wall
182B Wall
182C Wall
182D Wall
184 Riser
184A Extension of riser 184
184B Apex of extension 184A
190 Through-bore
192 Counterbore or recess
194 Countersink or recess
200 Aperture or flue
202A Wall
202B Wall
202C Wall
202D Wall
204 Riser
204A Extension of riser 204
204B Apex of extension 204A
206 Recess
210 Through-bore
212 Recess
214 Countersink or recess
300 Coal
A Angle
B Angle
D1 Direction
D2 Direction
D3 Direction
D4 Direction
L1 Length
L2 Length
L3 Length

What is claimed is:

1. A flue block for a heating wall of a coke oven battery, the flue block comprising:
   a block body having a top surface and a bottom surface;
   a first aperture and a second aperture extending through the block body from the top surface to the bottom surface; and,
   a first riser arranged in the first aperture and a second riser arranged in the second aperture, wherein:
      the first riser and the second riser are integrally formed with the block body within the respective apertures; and,
      a top of the first riser defines a first height and a top of the second riser defines a second height, both heights measured from the top surface of the block body, wherein at least one of the first height and the second height is greater than zero.

2. The flue block recited in claim 1, wherein the first height and the second height are different.

3. The flue block recited in claim 1, wherein both the first height and the second height are greater than zero.

4. The flue block recited in claim 1, wherein the block body further comprises:
   a first side end having a protruding section extending therefrom; and,
   a second side end having a recessed section therein, wherein the protruding section is arranged to be at least partially seated within the recessed section of an adjacently arranged flue block.

5. The flue block recited in claim 1, wherein the top surface comprises at least one groove extending thereacross.

6. The flue block recited in claim 1, wherein at least one of the first riser and the second riser comprises a countersink within the bottom surface of the block body.

7. The flue block recited in claim 1, wherein the second riser comprises:
   a recess within its top, and wherein the recess is constant in width in a first direction and variable in width in a second direction perpendicular to the first direction.

8. The flue block recited in claim 2, wherein both the first height and the second height are greater than zero.

9. The flue block recited in claim 2 wherein the block body further comprises:
   a first side end having a protruding section extending therefrom; and,
   a second side end having a recessed section therein, wherein the protruding section is arranged to be at least partially seated within the recessed section of an adjacently arranged flue block.

10. The flue block recited in claim 3, wherein the block body further comprises:
   a first side end having a protruding section extending therefrom; and,
   a second side end having a recessed section therein, wherein the protruding section is arranged to be at least partially seated within the recessed section of an adjacently arranged flue block.

11. The flue block recited in claim 2, wherein the top surface comprises at least one groove extending thereacross.

12. The flue block recited in claim 3, wherein the top surface comprises at least one groove extending thereacross.

13. The flue block recited in claim 4, wherein the top surface comprises at least one groove extending thereacross.

14. The flue block recited in claim 2, wherein at least one of the first riser and the second riser comprises a countersink within the bottom surface of the block body.

15. The flue block recited in claim 3, wherein at least one of the first riser and the second riser comprises a countersink within the bottom surface of the block body.

16. The flue block recited in claim 4, wherein at least one of the first riser and the second riser comprises a countersink within the bottom surface of the block body.

17. The flue block recited in claim 5, wherein at least one of the first riser and the second riser comprises a countersink within the bottom surface of the block body.

* * * * *